US011590572B2

(12) United States Patent
Garcia et al.

(10) Patent No.: US 11,590,572 B2
(45) **Date of Patent: *Feb. 28, 2023**

(54) CUTTING TOOL

(71) Applicant: SANDVIK INTELLECTUAL PROPERTY AB, Sandviken (SE)

(72) Inventors: Jose Luis Garcia, Stockholm (SE); Marta Saraiva, Bandhagen (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 88 days.

This patent is subject to a terminal disclaimer.

(21) Appl. No.: 16/476,903

(22) PCT Filed: Dec. 20, 2016

(86) PCT No.: PCT/EP2016/081929
§ 371 (c)(1),
(2) Date: Jul. 10, 2019

(87) PCT Pub. No.: WO2018/113923
PCT Pub. Date: Jun. 28, 2018

(65) Prior Publication Data

US 2019/0358707 A1 Nov. 28, 2019

(51) Int. Cl.
*B22F 7/00* (2006.01)
*B22F 3/10* (2006.01)
(Continued)

(52) U.S. Cl.
CPC ..... *B22F 7/008* (2013.01); *B22F 3/1017* (2013.01); *C22C 29/08* (2013.01);
(Continued)

(58) Field of Classification Search
CPC ..... B22F 7/008; B22F 3/1017; B22F 2003/242; B22F 2003/248; B22F 2005/001;
(Continued)

(56) References Cited

U.S. PATENT DOCUMENTS 4,743,515 A * 5/1988 Fischer ..... C23C 8/20 428/472
4,843,039 A 6/1989 Adesson et al.
(Continued)

FOREIGN PATENT DOCUMENTS

CN 101263236 A 9/2008
CN 103517777 A 1/2014
(Continued)

OTHER PUBLICATIONS

Podob, Mark, "Physical Vapor Deposition-Wear-Resistant & Decorative Coatings", Society of Vacuum Coaters' 39th Annual Technical Conference Proceedings (Year: 1996).*
(Continued)

*Primary Examiner* — Brian D Walck
*Assistant Examiner* — Danielle M. Carda
(74) *Attorney, Agent, or Firm* — Corinne R. Gorski

(57) ABSTRACT

A method of making a cutting tool includes providing a first sintered cemented carbide body of a WC, a metallic binder phase and eta phase and wherein the substoichiometric carbon content in the cemented carbide is between −0.30 to −0.16 wt %. The first sintered cemented carbide body is subjected to a heat treatment at a temperature of between 500 to 830° C. for a time between 1 to 24 h. A cutting tool made according to the above method having an increased resistance against comb cracks is also provided.

13 Claims, 2 Drawing Sheets

(51) Int. Cl.
*C22C 29/08* (2006.01)
*B22F 3/24* (2006.01)
*B22F 5/00* (2006.01)

(52) U.S. Cl.
CPC ..... *B22F 2003/242* (2013.01); *B22F 2003/248* (2013.01); *B22F 2005/001* (2013.01); *B22F 2301/10* (2013.01); *B22F 2301/15* (2013.01); *B22F 2301/35* (2013.01); *B22F 2998/10* (2013.01)

(58) Field of Classification Search
CPC ..... B22F 2301/10; B22F 2301/15; B22F 2301/35; B22F 2998/10; B22F 3/12; B22F 5/00; C22C 29/08; C22C 29/06; C22C 1/1094; C22C 1/1068
USPC ..... 419/18
See application file for complete search history.

(56) References Cited

U.S. PATENT DOCUMENTS

| | | | | |
|---|---|---|---|---|
| RE35,538 | E | 6/1997 | Angstrom et al. | |
| 2002/0051886 | A1 | 5/2002 | Blomstedt et al. | |
| 2003/0084752 | A1 | 5/2003 | Anderson | |
| 2010/0098506 | A1 | 4/2010 | Tanaka et al. | |
| 2019/0010583 | A1* | 1/2019 | Kesson | B22F 5/00 |

FOREIGN PATENT DOCUMENTS

| | | | | |
|---|---|---|---|---|
| CN | 104487192 | A | 4/2015 | |
| CN | 104611598 | A | 5/2015 | |
| EP | 0182759 | A1 | 5/1986 | |
| EP | 0493352 | A1 | 7/1992 | |
| EP | 1048750 | A1 | 11/2000 | |
| EP | 2691198 | A1 | 2/2014 | |
| WO | WO-2012130851 | A1 * | 10/2012 | B22F 7/00 |

OTHER PUBLICATIONS

Cadena et al. Study of PVD ALCrN Coating for Reducing Carbide Cutting Tool Deterioration in the Machining of Titanium Alloys, Materials, 6, pp. 2143-2154 (2013) (Year: 2013).*

Fukui, Haruyo, Evolutional History of Coating Technologies for Cemented Carbide Inserts-Chemical Vapor Deposition and Physical Vapor Deposition, SEI Technical Review, No. 82, Apr. 2016 (Year: 2016).*

* cited by examiner

CUTTING TOOL

RELATED APPLICATION DATA

This application is a § 371 National Stage Application of PCT International Application No. PCT/EP2016/081929 filed Dec. 20, 2016.

The present invention relates to a method of making a cutting tool comprising a substrate of cemented carbide which comprises a controlled amount of fine dispersed eta phase.

BACKGROUND

Cutting tools made of cemented carbide are known in the art.

The impact of the carbon content on the cemented carbide structure is well known. A shortage of carbon leads to the formation of eta phase, e.g. $W_6Co_6C$, $W_3Co_3C$, whereas an excess of carbon leads to precipitation of free graphite. The carbon content is usually balanced so that neither eta phase nor graphite is formed. Both eta phase and graphite are considered to be something to avoid. Cemented carbides that contain eta phase are known to be brittle and for that reason, eta phase is usually not desired.

However, there are some cemented carbide grades in the art where eta phase is formed deliberately. In U.S. Pat. No. 4,843,039, a coated cemented carbide insert is manufactured with a low carbon content so that, after sintering, the cemented carbide contains eta phase. The cemented carbide is then subjected to a carburizing treatment so that a gradient surface zone is formed. The surface zone is free from eta phase and has a lower Co content than the inner part of the cemented carbide. However these types of materials have not worked that well for cutting operations. Instead, these types of materials are usually used in mining applications like in EP0182759.

EP2691198 describes a cemented carbide suitable for mining applications which is reinforced by nano particles of eta phase in the binder phase. The grain size of the nano particles are less than 10 nm and the cemented carbide has a magnetic saturation of at least 0.70*201.9 $\mu m^3/kg$=141 $\mu m^3/kg$.

Comb cracks has been a problem for a long time in some milling applications and it has been an ongoing strive to find a cutting tool material that has an improved resistance against comb cracks and thus has a longer tool life.

It has been discovered that by providing a cemented carbide substrate with a controlled and well distributed eta phase, the resistance against comb cracks can be improved considerably.

DETAILED DESCRIPTION OF THE INVENTION

The present invention relates to a method of making a cutting tool comprising a cemented carbide substrate comprising the following steps:

providing a first sintered cemented carbide body comprising WC, a metallic binder phase and eta phase comprising $Me_{12}C$ and/or $Me_6C$ carbides where Me is selected from W, Mo and one or more of the binder phase metals and wherein the substoichiometric carbon content in the cemented carbide is between −0.30 to −0.16 wt % subjecting said first sintered cemented carbide body to a heat treatment at a temperature of between 500 to 830° C. for a time between 1 to 24 h.

The heat treatment is suitable performed at a temperature of between 500 to 830° C., preferably between 600 to 800° C. The time at an elevated temperature is suitably between 1 to 24 h, preferably between 1.5 to 8 h.

In one embodiment of the present invention, the heat treatment is taken place in a separate step, e.g. in a furnace.

In one embodiment of the present invention, the heat treatment is performed while the cemented carbide substrate is provided with a PVD coating, where the deposition temperature is such that the substrate temperature and deposition time will be within the ranges for the heat treatment as described above. The actual temperature of the substrate is usually lower that the given deposition temperature in the PVD chamber, so if the heat treatment is performed in the PVD chamber, it has to be established that the substrates have the appropriate temperature so that the aimed effect of the heat treatment is achieved.

In another embodiment of the present invention, the heat treatment is performed at the end of the sintering cycle, in the sintering furnace, during the cooling off period.

The heat treatment will affect the material so that it will have an increased resistance against comb cracks.

For cemented carbide substrates where the binder phase is Co, this change in properties can easily be measured by the change in coercivity (Hc). The heat treatment will cause an increase in coercivity (Hc).

If the temperature of the heat treatment would exceed 830° C., the effect in the coercivity will be much smaller and the positive effects will thereby be diminished.

Another way to see the effect of the heat treatment is to measure the ratio between the amounts of Co(fcc) and Co(hcp) in the cemented carbide. The heat treatment will increase the volume fraction of Co(hcp) in the binder phase.

By eta phase is herein meant carbides selected from $Me_{12}C$ and $Me_6C$ where Me is selected from W, Mo and one or more of the binder phase metals. Common carbides are $W_6Co_6C$, $W_3Co_3C$, $W_6Ni_6C$, $W_3Ni_3C$, $W_6Fe_6C$, $W_3Fe_3C$.

In one embodiment of the present invention, the eta phase comprises both $Me_{12}C$ and $Me_6C$.

In one embodiment of the present invention, the eta phase is free from Mo.

In yet another embodiment of the present invention, the eta phase contains Mo. If Mo is present in the cemented carbide, the Mo will replace some of the tungsten in the eta phase.

The average grain size of the eta phase is suitably between 0.1 to 10 μm, preferably between 0.5 to 3 μm.

The distribution of the eta phase should be as even as possible.

In one embodiment of the present invention, the volume fraction of the eta phase is suitably between 2 and 10 vol %, preferably between 4 and 8 vol % and more preferably between 4 to 6 vol %.

In one embodiment of the present invention, the eta phase distribution is the same throughout the whole cemented carbide substrate. By that is herein meant that the cemented carbide does not comprise any gradients of eta phase or zones without eta phase, like the gradient in e.g. U.S. Pat. No. 4,843,039.

The cemented carbide in the present invention has a substoichiometric carbon content within certain ranges. Substoichiometric carbon is a measure of the carbon content in relation to the stoichiometric carbon value. The substoichionetric value is a good measurement to use since it is not dependent on other parameters like binder phase content, other carbides etc.

The carbon balance in the cemented carbide is of importance in order to control the eta phase formation. Suitably the carbon content in the cemented carbide is between −0.30 and −0.16 wt % substoichiometric carbon, preferably between −0.28 and −0.17 wt % substoichiometric carbon.

The stoichiometric carbon content on the other hand is dependent on other parameters like binder phase content etc. The stoichiometric carbon content is a calculated value and can be calculated for both a powder blend as well as for a sintered cemented carbide. For a powder, prior to sintering, the stoichiometric value is calculated by assuming that the WC is completely stoichiometric, i.e. that the atomic ratio W:C is 1:1. If other carbides are present, also those are assumed to be stoichiometric.

When the stoichiometric carbon content is calculated for a sintered cemented carbide, e.g. consisting of Co and WC, it can either be done based on the amount of added WC raw material, assuming that the atomic ratio W:C is 1:1, or, from measurements on the sintered material, and then from the measured tungsten content calculate the stoichiometric carbon content assuming that the atomic ratio W:C is 1:1.

This means that the term substoichiometric carbon, as used herein, is the total carbon content determined by chemical analysis minus the calculated stoichiometric carbon content based on WC and possible other carbides present in the cemented carbide.

As an example, if the calculated stoichiometric carbon content for a particular cemented carbide is 5.60 wt %, and the same cemented carbide would be made, but with a carbon content of 5.30 wt %, the substoichiometric carbon would be −0.30 wt %.

In order to be able to achieve the well distributed eta phase which is necessary to obtain the improved resistance against comb cracks, achieving the correct carbon content is essential. Hence, it is not just the mere presence of eta phase that will give the improvement in resistance against comb cracks, the eta phase needs to be well distributed in a suitable amount. This is achieved by controlling the carbon balance carefully during manufacturing.

If the carbon content in the sintered cemented carbide is too low, i.e. lower than −0.30 wt % substoichiometric, the amount of eta phase becomes too large and the cemented carbide will be brittle. On the other hand, if the carbon content is higher than the claimed range, i.e. above −0.16 but still in the eta phase forming region, the formed eta phase will be unevenly distributed like in large clusters leading to a decrease in toughness of the cemented carbide. The limits for the range for the substoichiometric carbon content are based on the analyses achieved by the method described in the examples. The difference in carbon content between achieving the unwanted large clusters of eta phase, see e.g. FIG. 3, and achieving the finely distributed eta phase, see FIG. 1, that it is aimed for, can be very small. Being close to that limit requires monitoring the microstructure to make sure that the unwanted large clusters are avoided.

The cemented carbide according to the present invention should have an evenly distributed eta phase, by that is herein meant that the cemented carbide is free from large clusters of eta phase.

The binder phase is suitably selected from one or more of Fe, Co and Ni, preferably Co, in an amount of 2 to 20 wt % of the sintered body, preferably between 5 to 12 wt % of the sintered body.

In one embodiment of the present invention, when Cr is present in the cemented carbide, some of the Cr is dissolved in the binder phase.

The amount of WC in the cemented carbide is suitably from 80 to 98 wt %. The grain size (FSSS) of the WC in the raw material powder prior to sintering is suitably between 0.1 and 12 μm, preferably between 0.4 to 9 μm.

In one embodiment of the present invention, the cemented carbide also comprises Mo in an amount of from 0.5 to 20 wt %, preferably 0.8 to 5 wt %.

The cemented carbide can also comprise other constituents common in the art of cemented carbides, e.g. carbides, carbonitrides or nitrides of one or more of Ti, Ta, Nb, Cr or V.

The first cemented carbide body is manufactured according to conventional methods known in the art, i.e. by providing powders forming hard constituents, powders forming the binder phase and an organic pressing agent, e.g. PEG. The powders are mixed with a milling liquid. The formed slurry is then subjected to milling, drying, pressing and sintering to form a first sintered cemented carbide body. The appropriate substoichiometric carbon value is achieved by adding one or more of W, $W_2C$, Mo or $Mo_2C$ to the slurry. Usually some carbon is lost during sintering due to the presence of oxygen. The oxygen will react with carbon and leave as CO or $CO_2$ during sintering thus shifting the carbon balance so that the added amount of one or more of W, $W_2C$, Mo or $Mo_2C$ has to be adjusted. Exactly how much carbon that is lost during sintering depends on the raw material and production techniques used and it is up to the skilled person in the art to adjust the W, $W_2C$, Mo or $Mo_2C$ additions so that the aimed substoichiometric carbon content in the sintered material is achieved.

The powders forming hard constituents are selected from WC and other constituents common in the art of cemented carbides, e.g. carbides, carbonitrides or nitrides of one or more of Ti, Ta, Nb, Cr or V.

In one embodiment of the present invention, the cemented carbide insert is provided with a wear resistant PVD (Physical vapor deposition) coating.

In one embodiment of the present invention, the cemented carbide insert is provided with a wear resistant PVD coating, suitably being a nitride, oxide, carbide or mixtures thereof of one or more of the elements selected from Al, Si and groups 4, 5 and 6 in the periodic table.

The coating can also be subjected to additional treatments known in the art, such as brushing, blasting etc.

By cutting tool is herein meant an insert, end mill or drill.

In one embodiment of the present invention, the cutting tool is an insert, preferably a milling insert.

In one embodiment of the present invention, the cemented carbide substrate is used for milling in cast iron, steel, Ti-alloys.

The present invention also relates to a cutting tool comprising a cemented carbide substrate made according to the method described above.

The cutting tool made according to the method described above comprises a cemented carbide substrate comprising WC and a binder phase comprising one or more of Co, Fe and Ni wherein the cemented carbide also comprises eta phase comprising $Me_{12}C$ and/or $Me_6C$ carbides where Me is one or more metals selected from W, Mo and the binder phase metals wherein the substoichiometric carbon content in the cemented carbide is between −0.30 to −0.16 wt %.

For cemented carbide substrates where the binder phase is Co, this change in properties can easily be measured by the change in coercivity (Hc). The heat treatment will cause an increase in coercivity (Hc). The coercivity measured after the heat treatment will be at least 1.5 kA/m, preferably at least 2.5 kA/m higher than the coercivity measured before the heat treatment.

If the temperature of the heat treatment would exceed 830° C., the effect in the coercivity will be much smaller and the positive effects will thereby be diminished.

Another way to see the effect of the heat treatment is to measure the ratio between the volume fraction of Co(fcc) and Co(hcp) in the cemented carbide. Suitably the ratio of Co(fcc)/Co(hcp) after the heat treatment would be lower than 80/20, preferably lower than 70/30. The Co(fcc) and Co(hcp) are suitably measured by EBSD.

DETAILED DESCRIPTION OF THE DRAWINGS

Example 1

Figure 1:
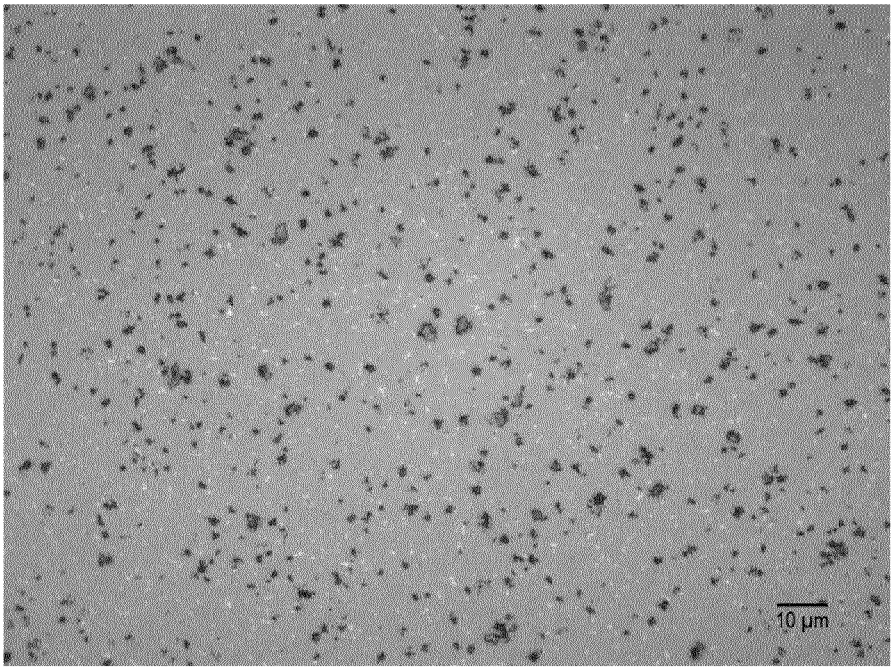
FIG. 1 shows a LOM image of a cemented carbide according to the present invention having a substoichiometric carbon content in the sintered body of −0.17 wt %.
Figure 2:
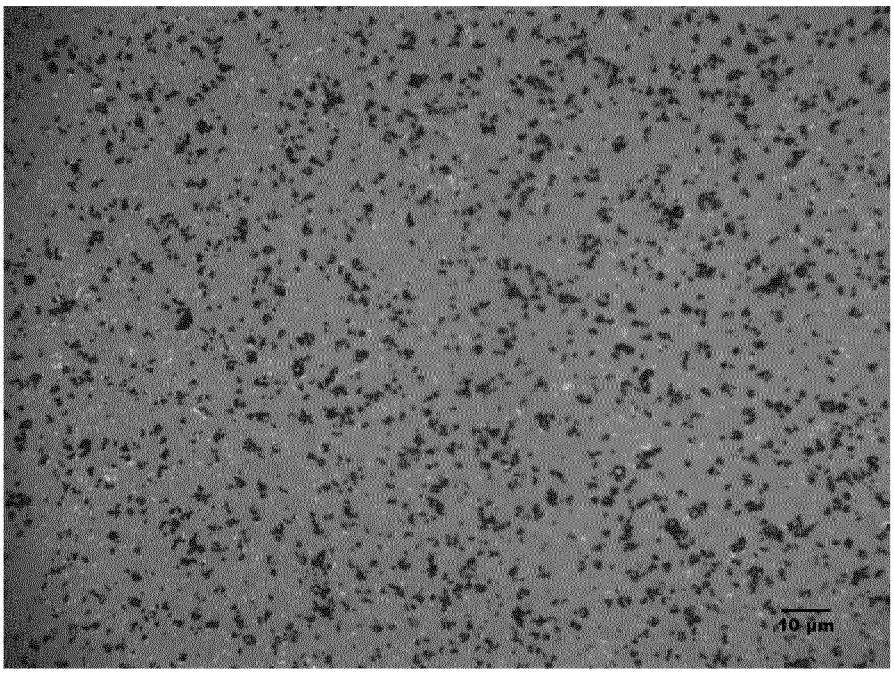
FIG. 2 shows a LOM image of a cemented carbide made from a powder having a carbon content which is less than what is claimed, a substoichiometric carbon content of −0.35 wt %.
Figure 3:
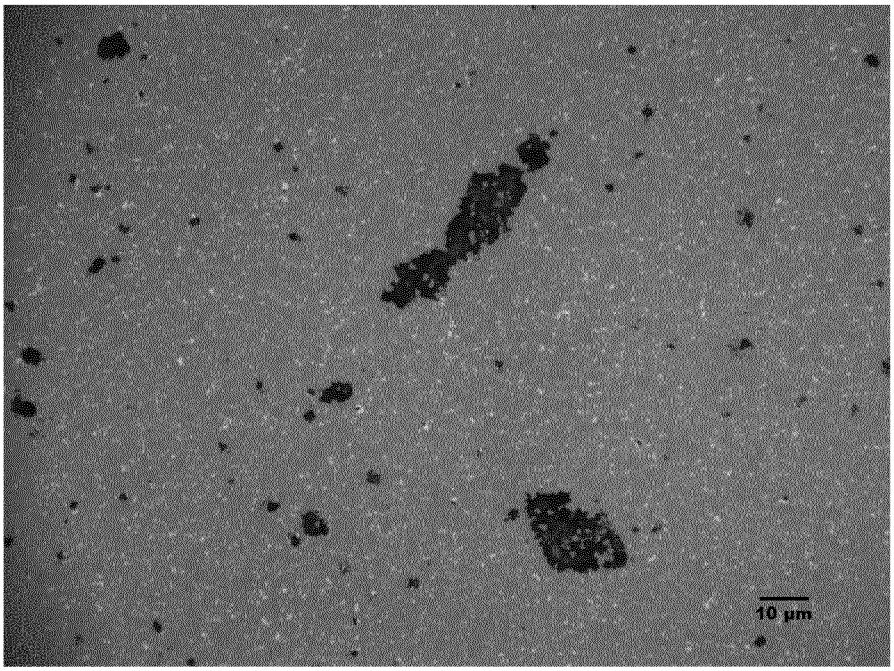
FIG. 3 shows a LOM image of a cemented carbide having a substoichiometric carbon content in the sintered body of −0.15 wt %, i.e. a carbon content that is more than what is claimed.

Two sintered substrates were prepared. Their compositions are shown in Table 1.

TABLE 1

| | Co (wt %)* | Vol % eta phase | magnetic-% Co | Substoichiometric carbon in sintered body (wt %) | Hardness (HV3) ± 10 |
|---|---|---|---|---|---|
| Substrate 1 | 7.4 | 4.8 | 69 | −0.24 | 1600 |
| Reference 1 | 6.0 | 0 | 88 | −0.09 | 1600 |

*Total Co in the material, i.e. amount of Co powder added.

The amount of eta phase was determined by image analysis using the software Image J using the setup "Automatic". The images used for the analysis was LOM images with a magnification of 500× and 1000×, two measurements were done at each magnification and the values in Table 2 are an average value of these. The value in the table is an average from a total of four image analyses performed on two images, 2 measurements on each image. The magnetic-% Co was determined by analyzing with a Foerster Koerzimat CS 1.096 from Foerster Instruments Inc. using the standard DIN IEC 60404-7. The results are shown in Table 1.

The stoichiometric carbon content in the sintered material is calculated by first measuring the total carbon content by using a LECO WC-600 instrument, for this analysis, the sample was crushed prior to the analysis. The accuracy of the values is ±0.01 wt %. The Co content is measured with XRF (X-ray fluorescence) using a Panalytical Axios Max Advanced instrument. By subtracting the cobalt and carbon amounts from the total weight of the sample, the W content is achieved which is used to calculated the stoichiometric carbon content, assuming the WC has a 1:1 ratio.

By subtracting the stoichiometric carbon content from the total carbon as measured by the LECO WC-600 instrument, the substoichiometric carbon content is achieved.

Reference 1 is aimed to be the same cemented carbide as in Invention 1 but without the eta phase. The reason why the cobalt content differs between Invention 1 and Reference 1 is that, when eta phase is formed, Co is consumed since Co is part of the eta phase. That means that the amount of metallic cobalt, i.e. the amount of cobalt that functions as a binder in the cemented carbide, will be less than the amount added unless extra cobalt is added to compensate. For Substrate 1, 7.4 wt % Co is the total amount of Co that has been added, whereas the amount of metallic cobalt in Substrate 1 has been estimated to be around 6 wt %.

Example 2 (Heat Treatment)

Substrate 1 was subjected to a heat treatment for 2 h in 650° C. The heat treated substrate 1 and the untreated substrate 1 together with Reference 1 were then provided with the same PVD coating deposited at 700° C. The heat treated substrate with coating is herein after denoted Invention 1, the untreated substrate with coating is denoted Comparative 1 and the coated reference 1 is denoted Reference 1.

The coercivity and the magnetic Co % were analyzed before and after the deposition. The results are shown in Table 2. The coercivity was measured according to ISO3326.

The Co(fcc) and Co(hcp) were measured on all samples using EBSD. Samples were prepared by ion polishing and the prepared samples were mounted on to a sample holder and inserted into the scanning electron microscope (SEM). The samples were tilted 70° with respect to the horizontal plane and towards the EBSD detector. The SEM used for the characterization was a Zeiss Supra 55 VP operated at 15 kV, using a 60 μm objective aperture applying "High current" mode and operated in variable pressure (VP) mode at a SEM chamber pressure of 0.128 Torr. The used EBSD detector was an Oxford Instruments NordlysMax Detector.

The parameters used for measuring the samples, like e.g. step size etc., were the same for all samples. The achieved data was also treated in the same way, with regard to noise reduction etc. for all samples. The results can be shown in Table 2.

TABLE 2

| | Coercivity prior to heat treatment and PVD deposition (kA/m) | Coercivity after PVD deposition (kA/m) | magnetic Co % prior to heat treatment and PVD deposition | magnetic Co % after PVD deposition | fcc/hcp fraction for Co |
|---|---|---|---|---|---|
| Invention 1 | 16.93 | 21.21 | 69 | 67 | 60/40 |
| Comparative 1 | 16.93 | 16.88 | 69 | 68 | 90/10 |
| Reference 1 | 17.73 | 17.64 | 88 | 87 | 90/10 |

Example 3 (Working Examples)

In this test, a face milling test, a coated cemented carbide according to the present invention has been compared to three inserts according to prior art, all having the same geometry. The test has been performed in Gray cast iron, SS0125; under wet conditions with the following cutting parameters:

Vc: 300

Fz: 0.35

Ap: 3

Ae: 29 mm

Tool life criterion was chipping/crack to a depth of 0.30 mm. The number of passes below is an average of 3 tests each.

Comparative 1 is an insert that has previously been used for these types of applications. The results can be seen in Table 3.

TABLE 3

| | Tool life (No of passes) |
|---|---|
| Invention 1 | 28 |
| Comparative 1 | 16 |
| Reference 1 | 10 |

Example 4

To investigate the effect of the duration of the heat treatment, the cemented carbide substrate as disclosed in Example 1, Invention 1, was subjected to heat treatment in 650° C., for different number of hours. The coercivity was measured before and after the heat treatment and the difference in coercivity is denoted ΔHC.

TABLE 4

| Time (h) | 0.5 | 2 | 4 | 8 | 12 | 24 |
|---|---|---|---|---|---|---|
| ΔHC (kA/m) | 1.8 | 4.6 | 6 | 7.3 | 8.2 | 8.6 |

As can be seen, the time is affecting the change in coercivity in such a way that the difference in coercivity increases the longer the heat treatment.

The invention claimed is:

1. A method of making a cutting tool having a cemented carbide substrate, the method comprising the steps of:

providing a first sintered cemented carbide body comprising a WC, a metallic binder phase and eta phase comprising $Me_{12}C$ and/or $Me_6C$ carbides, wherein Me is selected from W, Mo and one or more of the binder phase metals, wherein a substoichiometric carbon content in the cemented carbide is between −0.30 to −0.16 wt %, and wherein the eta phase distribution in the first cemented carbide body is the same throughout the whole cemented carbide substrate, and wherein the eta phase in the first cemented carbide body has a grain size of 0.1 to 10 μm; and subjecting said first sintered cemented carbide body to a heat treatment at a temperature of between 500 to 830° C. for a time between 1 to 24 h.

2. The method according to claim 1, wherein the temperature for the heat treatment is between 600 and 800° C. for a duration of 1.5 to 8 h.

3. The method according to claim 1, wherein the heat treatment occurs in a separate furnace.

4. The method according to claim 1, wherein the heat treatment step is performed by subjecting the first cemented carbide body to a Physical Vapor Deposition process where the substrate temperature is between 500 to 830° C. and the deposition time is between 1.5 to 24 h.

5. The method according to claim 1, wherein the substoichiometric carbon content in the first cemented carbide body is between −0.28 to −0.17 wt %.

6. The method according to claim 1, wherein the amount of eta phase in the first cemented carbide body is between 2 to 10 vol %.

7. The method according to claim 1, wherein in the first cemented carbide body the binder phase content is 2 to 20 wt %.

8. The method according to claim 1, wherein the binder phase in the first cemented carbide body is cobalt.

9. The method according to claim 1, wherein the cutting tool is provided with a PVD coating.

10. A cutting tool comprising a cemented carbide substrate made according to the method of claim 1.

11. The cutting tool according to claim 10, comprising a cemented carbide substrate comprising WC and a binder phase comprising one or more of Co, Fe and Ni, wherein the cemented carbide has an eta phase comprising $Me_{12}C$ and/or $Me_6C$ carbides, wherein Me is one or more metals selected from W, Mo and the binder phase metals, wherein a substoichiometric carbon content in the cemented carbide is between −0.30 to −0.16 wt %.

12. The cutting tool according to claim 10, wherein the binder phase is Co and wherein the coercivity after the heat treatment is at least 1.5 kA/m higher than as measured before the heat treatment.

13. The cutting tool according to claim 10, wherein the volume ratio between Co(fcc)/Co(hcp) is lower than 80/20.

* * * * *